US011975935B2

(12) United States Patent
Johnson

(10) Patent No.: US 11,975,935 B2
(45) Date of Patent: May 7, 2024

(54) MASK DISPENSING ASSEMBLY

(71) Applicant: Mark Johnson, Houston, TX (US)

(72) Inventor: Mark Johnson, Houston, TX (US)

( * ) Notice: Subject to any disclaimer, the term of this patent is extended or adjusted under 35 U.S.C. 154(b) by 538 days.

(21) Appl. No.: 17/203,119

(22) Filed: Mar. 16, 2021

(65) Prior Publication Data

US 2022/0297969 A1 Sep. 22, 2022

(51) Int. Cl.
*B65H 29/20* (2006.01)
*B65D 83/08* (2006.01)

(52) U.S. Cl.
CPC ..... *B65H 29/20* (2013.01); *B65D 83/0817* (2013.01); *B65H 2701/19* (2013.01)

(58) Field of Classification Search
CPC .. A47K 10/422; A47K 10/426; A47K 10/427; B65D 83/087; B65D 83/0858; B65H 29/20; B65H 2701/19
See application file for complete search history.

(56) References Cited

U.S. PATENT DOCUMENTS 2,806,634 A * 9/1957 Baumgartner ..... A47F 1/08 221/301
3,416,705 A * 12/1968 Hohmann ..... G07B 3/04 221/9
3,734,344 A * 5/1973 Teichelman ..... G07F 9/02 221/22
4,550,856 A 11/1985 Ballmann
6,708,841 B2 3/2004 Baughman
6,763,970 B2 7/2004 Harris
D681,987 S 5/2013 Cittadino
9,272,838 B2 3/2016 Tsuel
2006/0010563 A1 1/2006 Michel
2007/0213877 A1 9/2007 Hart
2007/0228066 A1* 10/2007 Almas ..... B65D 83/0858 221/211
2009/0277923 A1* 11/2009 Funke ..... B65D 83/0811 221/209
2011/0114660 A1* 5/2011 Johansson ..... A61F 15/001 221/36
2015/0091422 A1 4/2015 Adler
2021/0043023 A1* 2/2021 Coder ..... G07F 11/005

FOREIGN PATENT DOCUMENTS

WO WO20150091422 4/2015

* cited by examiner

*Primary Examiner* — Gene O Crawford
*Assistant Examiner* — Kelvin L Randall, Jr.

(57) ABSTRACT

A mask dispensing assembly includes a housing that is positionable in a public transportation vehicle and the housing has a dispensing slot extending into an interior of the housing to dispense face masks stored in the housing to the passengers. A lifting unit is positioned within the housing to lift a stack of disposable face masks in the housing thereby aligning a topmost one of the stack of disposable face masks with the slot. A dispenser is positioned in the housing to urge the topmost one of the stack of disposable face masks outwardly through the slot. A switch is positioned in the public transportation and the lifting unit is actuated when the switch is depressed to facilitate the driver to dispense a disposable mask for a passenger to wear.

12 Claims, 5 Drawing Sheets

MASK DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispensing devices and more particularly pertains to a new dispensing device for dispensing disposable face masks on a public transportation vehicle. The device includes a switch that is positioned next to a driver of the public transportation vehicle. The device dispenses a disposable face mask when the switch is depressed.

(2) Description of Related Art Including Information Disclosed Under 37 CFR 1.97 and 1.98

The prior art relates to dispensing devices including a variety of containers that are structured to containing disposable face masks. In several instances the containers have a dispensing slot integrated therein. The prior art discloses a system for dispensing face masks from a stack that is contained in a housing. In no instance does the prior art disclose a dispenser for automatically dispensing disposable face masks.

BRIEF SUMMARY OF THE INVENTION

An embodiment of the disclosure meets the needs presented above by generally comprising a housing that is positionable in a public transportation vehicle and the housing has a dispensing slot extending into an interior of the housing to dispense face masks stored in the housing to the passengers. A lifting unit is positioned within the housing to lift a stack of disposable face masks in the housing thereby aligning a topmost one of the stack of disposable face masks with the slot. A dispenser is positioned in the housing to urge the topmost one of the stack of disposable face masks outwardly through the slot. A switch is positioned in the public transportation and the lifting unit is actuated when the switch is depressed to facilitate the driver to dispense a disposable mask for a passenger to wear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
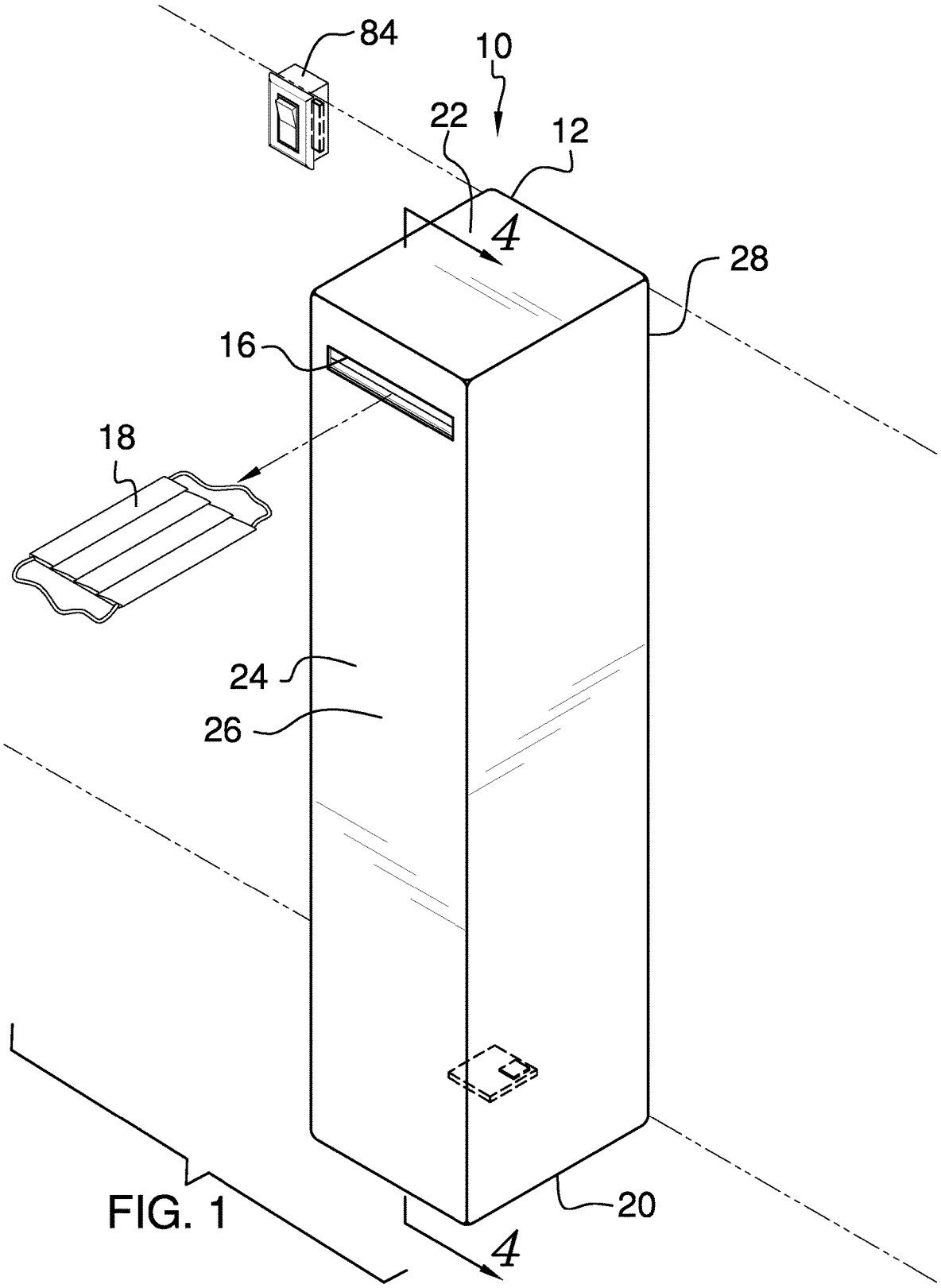
FIG. 1 is a perspective view of a mask dispensing assembly according to an embodiment of the disclosure.
Figure 2:
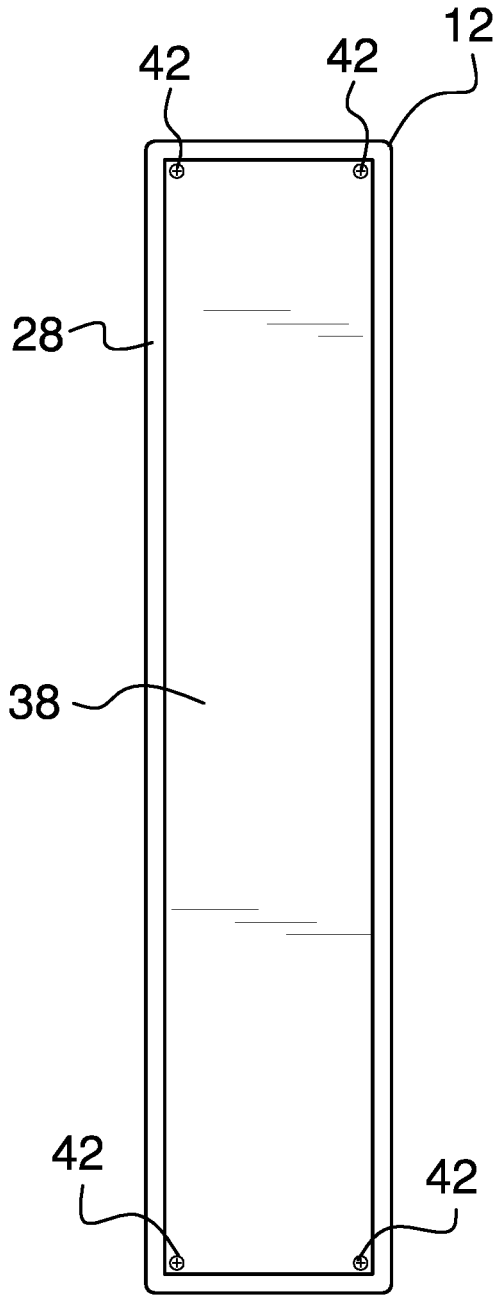
FIG. 2 is a back view of an embodiment of the disclosure.
Figure 3:
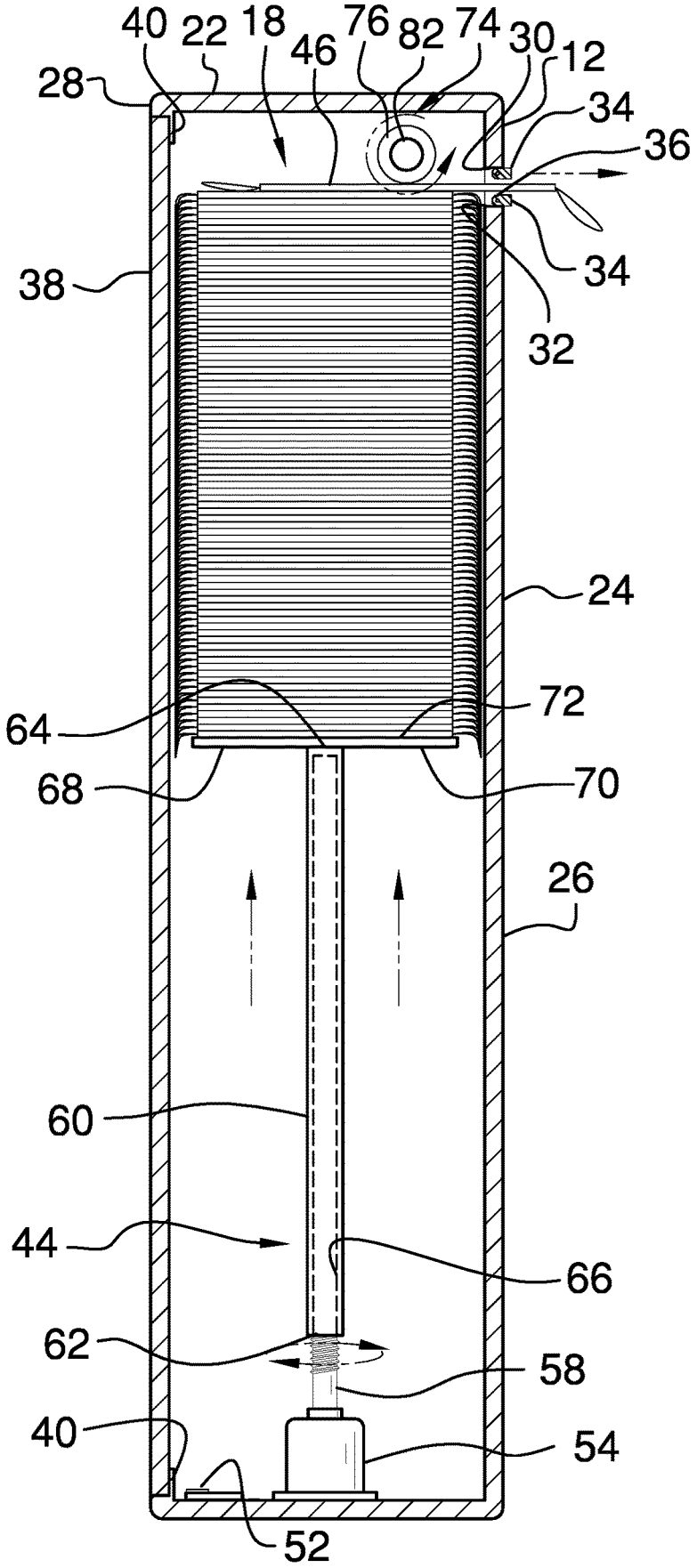
FIG. 3 is a cross sectional view taken along line 3-3 of FIG. 1 of an embodiment of the disclosure.
Figure 4:
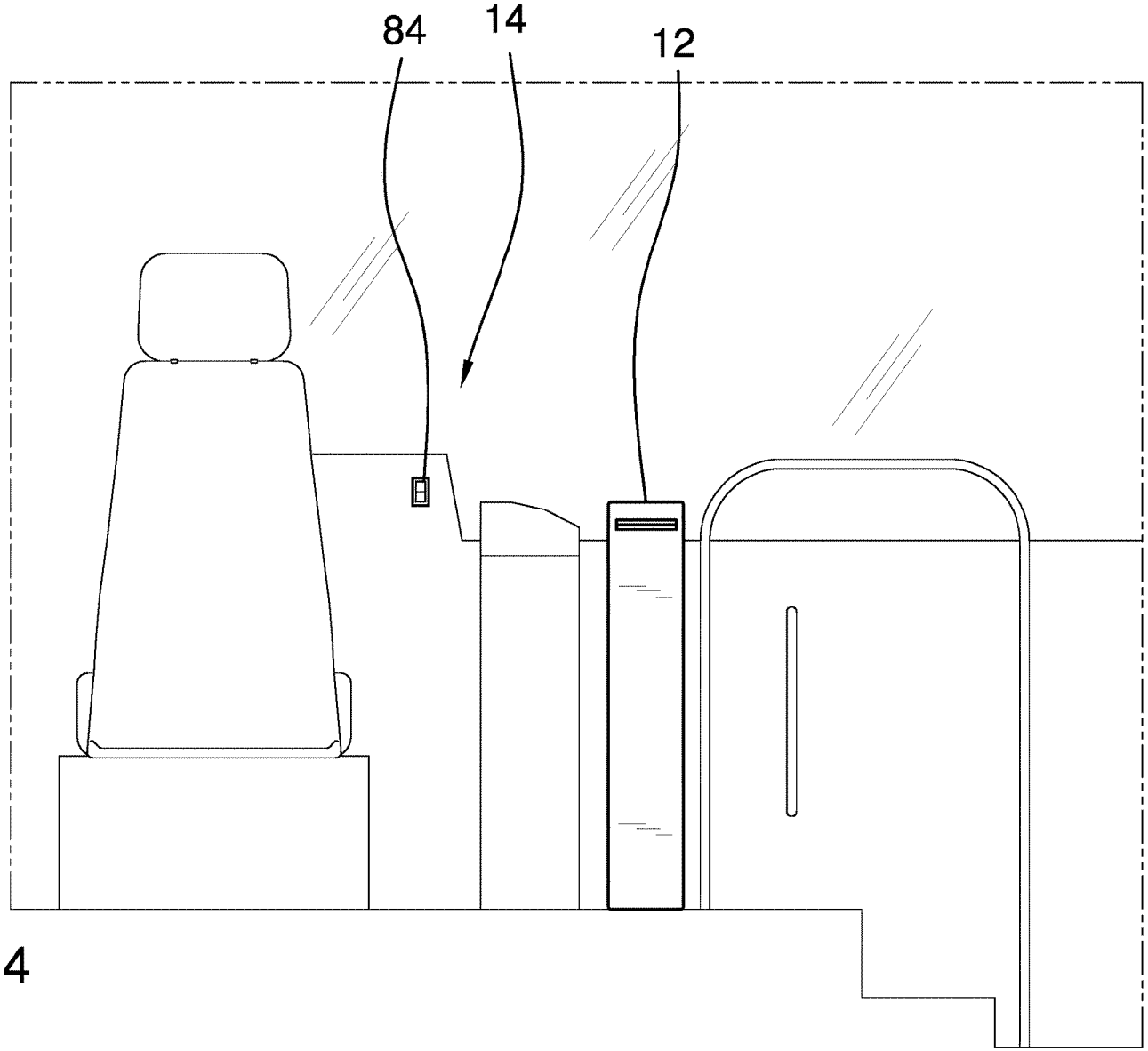
FIG. 4 is a perspective in-use view of an embodiment of the disclosure.
Figure 5:
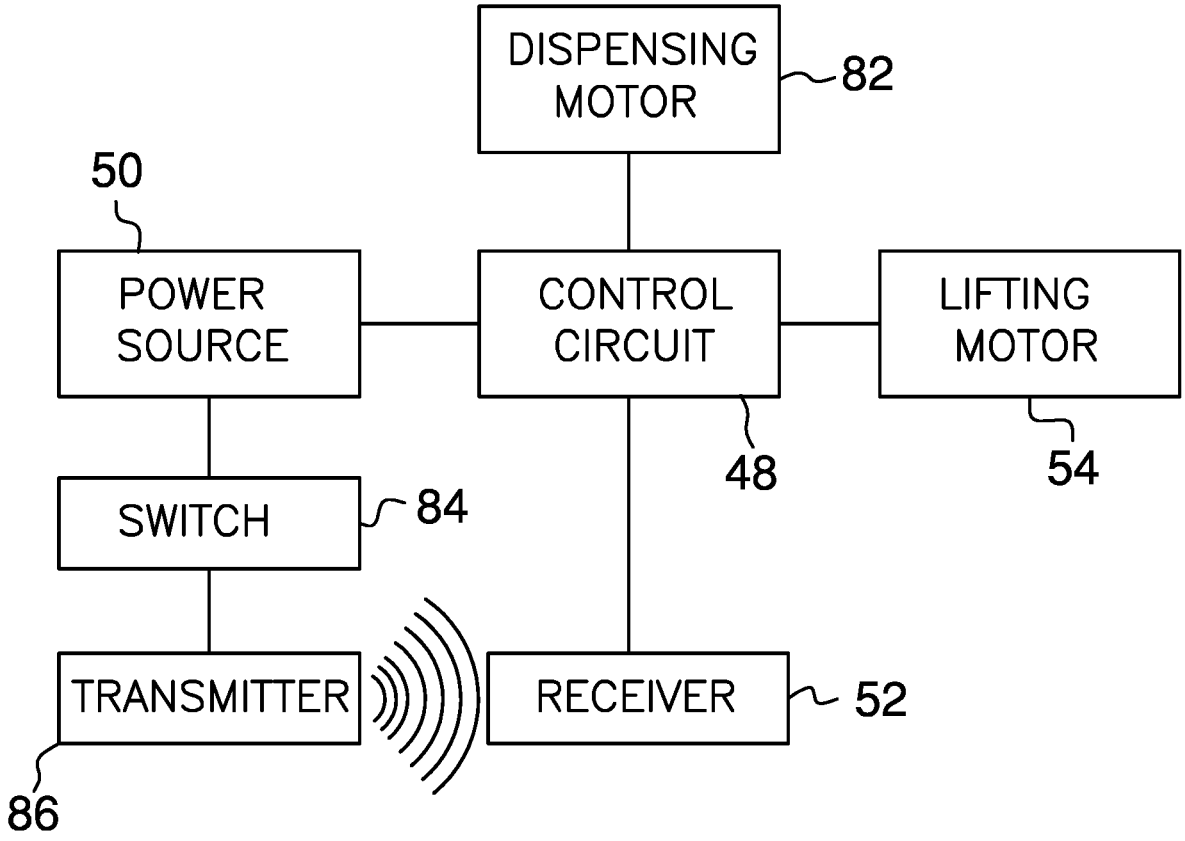
FIG. 5 is a schematic view of an embodiment of the disclosure.

With reference now to the drawings, and in particular to FIGS. 1 through 5 thereof, a new dispensing device embodying the principles and concepts of an embodiment of the disclosure and generally designated by the reference numeral 10 will be described.

As best illustrated in FIGS. 1 through 5, the mask dispensing assembly 10 generally comprises a housing 12 that is positionable in a public transportation vehicle 14 such that the housing 12 is accessible to passengers on the public transportation vehicle 14. The public transportation vehicle 14 may be bus, a train or other type of multiple passenger vehicle. The housing 12 has a dispensing slot 16 extending into an interior of the housing 12 to dispense face masks stored in the housing 12 to the passengers. The face masks may comprise disposable face masks 18 that comply with CDC guidelines for personal protective equipment during a pandemic. Additionally, the housing 12 may be positioned in a public building, such as a hospital, school, grocery store or other location that would be commonly occupied by the general public.

The housing 12 has a bottom wall 20, a top wall 22 and an outer wall 24 extending therebetween, and the outer wall 24 has a front side 26 and a back side 28. The back side 28 is open to access an interior of the housing 12 to facilitate the housing 12 to be filled with a stack of the disposable face masks 18. The dispensing slot 16 extends through the front side 26 into an interior of the housing 12, the dispensing slot 16 is positioned adjacent to the top wall 22, and the dispensing slot 16 has an upper bounding edge 30 and a lower bounding edge 32. The housing 12 may be elongated between the top wall 22 and the bottom wall 20 to a height ranging between approximately 36.0 inches and 48.0 inches.

A pair of doors 34 is provided and each of the doors 34 has a first edge 36. The first edge 36 of each of the doors 34 is hingedly coupled to a respective one of the upper bounding edge 30 and the lower bounding edge 32. Each of the doors 34 is positionable in a closed position having each of the doors 34 lying on a horizontal plane in the dispensing slot 16. Each of the doors 34 is positionable in an open position having each of the doors 34 extending forwardly from the dispensing slot 16.

A cover 38 is removably attachable to the housing 12, and the cover 38 is positionable on the back side 28 of the outer wall 24 to close the back side 28. As is most clearly shown in FIG. 3, the housing 12 may include a pair of ledges 40 that is each positioned on a respective one of the top wall 22 and the bottom wall 20. The ledges 40 may be recessed with respect to the back side 28 such that the cover 38 rests against the ledges 40. A plurality of fasteners 42 may each extend through the cover 38 and engage respective ledges 40.

A lifting unit 44 is positioned within the housing 12 and the stack of disposable face masks 18 is positioned on the lifting unit 44. The lifting unit 44 is actuated to incrementally lift upwardly in the housing 12 thereby lifting the stack of disposable face masks 18 in the housing 12. In this way a topmost one of the stack of disposable face masks 46 is aligned with the dispensing slot 16. The lifting unit 44 comprises a control circuit 48 that is positioned in the housing 12. The control circuit 48 receives a lift input and a refill input. The control circuit 48 is electrically coupled to a power source 50 comprising an electrical system of the public transportation vehicle 14.

The lifting unit 44 includes a receiver 52 that is positioned in the housing 12 and the receiver 52 is electrically coupled to the control circuit 48. The control circuit 48 receives the lift input when the receiver 52 receives a lift signal, and the control circuit 48 receives the refill input when the receiver 52 receives a refill signal. The receiver 52 may comprise a radio frequency receiver or the like. A lifting motor 54 is coupled to a top surface 56 of the bottom wall 20 of the housing 12 such that the lifting motor 54 is positioned within the housing 12.

The lifting motor 54 is electrically coupled to the control circuit 48 and the lifting motor 54 is actuated to rotate in a first direction when the control circuit 48 receives the lift input. Additionally, the lifting motor 54 turns a predetermined number of revolutions each time the control circuit 48 receives the lift input. The lifting motor 54 is actuated to rotate in a second direction when the control circuit 48 receives the refill input. The lifting motor 54 may comprise an electric motor or the like.

The lifting unit 44 includes a screw 58 that is rotatably coupled to the lifting motor 54 such that the screw 58 rotates in a first direction when the lifting motor 54 is rotates in the first direction. The screw 58 rotates in a second direction when the lifting motor 54 rotates in the second direction. The lifting unit 44 includes a tube 60 that that has a first end 62, a second end 64 and an interior surface 66. The first end 62 is open and the interior surface 66 is threaded. Moreover, the first end 62 insertably receives the screw 58 and the screw 58 threadably engages the interior surface 66. In this way the tube 60 is lifted upwardly each time the screw 58 rotates in the first direction and the tube 60 is fully lowered onto the screw 58 when the screw 58 rotates in the second direction.

The lifting unit 44 includes a plate 68 that has a lower surface 70 and a top surface 72. The lower surface 70 is coupled to the second end 64 of the tube 60 and the stack of disposable face masks 18 is positioned on the top surface 72. The plate 68 is lifted toward the top wall 22 of the housing 12 when the screw 58 is rotated in the first direction. The plate 68 is lowered toward the lifting motor 54 when the screw 58 is rotated in the second direction.

A dispenser 74 is positioned in the housing 12 and the dispenser 74 engages the topmost one of the stack of disposable face masks 46. The dispenser 74 is aligned with the dispensing slot 16 to urge the topmost one of the stack of disposable face masks 46 outwardly through the dispensing slot 16. The dispenser 74 comprises a dispensing wheel 76 that is rotatably integrated into the housing 12. The dispensing wheel 76 is aligned with the dispensing slot 16 to frictionally engage the topmost one of the stack of disposable face masks 46. In this way the dispensing wheel 76 can urge the topmost one of the stack of disposable face masks 46 outwardly through the dispensing slot 16. The dispensing wheel 76 has an outer surface 78 and the outer surface 78 is rotated about a center point of the dispensing wheel 76 when the dispensing wheel 76 is rotated. In this way a bottom side 80 of the dispensing wheel 76 travels toward the dispensing slot 16 when the dispensing wheel 76 is rotated.

The dispenser 74 includes a dispensing motor 82 that is positioned in the housing 12. The dispensing motor 82 rotatably engages the dispensing wheel 76 and the dispensing motor 82 is electrically coupled to the control circuit 48. The dispensing motor 82 is turned on to rotate a predetermined number of rotations when the control circuit 48 receives the lift input. The dispensing motor 82 may comprise an electric motor or the like.

A switch 84 is positioned in the public transportation vehicle 14 such that the switch 84 is accessible to a driver of the public transportation vehicle 14. The switch 84 is in communication with the lifting unit 44 in the housing 12 and the dispenser 74. The lifting unit 44 is actuated when the switch 84 is depressed to facilitate the driver to dispense a disposable face mask 18 for a passenger to wear. The switch 84 is electrically coupled to a power source 50 comprising the electrical system of the public transportation vehicle 14. Additionally, the switch 84 is positionable in a lifting position or a refill position, and the switch 84 is biased into an off position.

A transmitter 86 is integrated into the switch 84 and the transmitter 86 is electrically coupled to the switch 84. Additionally, the transmitter 86 is in wireless communication with the receiver 52 in the lifting unit 44. The transmitter 86 broadcasts the lift signal when the switch 84 is positioned in the lifting position and the transmitter 86 broadcasts the refill signal when the switch 84 is positioned in the refill position. The transmitter 86 may comprise a radio frequency transmitter or the like.

In use, the driver depresses the switch 84 into the lifting position to dispense a disposable mask from the housing 12. In this way a passenger can be supplied a disposable face mask 18 when the passenger is boarding the public transportation vehicle 14 without a face mask. The disposable face mask 18 urges each of the doors 34 into the open position as the disposable face mask 18 is dispensed from the dispensing slot 16. The driver depresses the switch 84 into the refill position when the housing 12 is depleted of the disposable face masks 18. In this way housing 12 can be refilled with a stack of the disposable face masks 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mask dispensing assembly for dispensing face masks in a public transportation vehicle, said assembly comprising:

a housing being positionable in a public transportation vehicle wherein said housing is configured to be accessible to passengers on the public transportation vehicle, said housing having a dispensing slot extending into an interior of said housing wherein said dispensing slot is configured to dispense face masks stored in said housing to the passengers;

a lifting unit being positioned within said housing wherein said lifting unit is configured to have the stack of disposable face masks being positioned thereon, said lifting unit being actuated to incrementally lift upwardly in said housing wherein said lifting unit is configured to lift the stack of disposable face masks in said housing thereby aligning a topmost one of said stack of disposable face masks with said slot;

a dispenser being positioned in said housing, said dispenser engaging the topmost one of the stack of disposable face masks, said dispenser being aligned with said slot wherein said dispenser is configured to urge the topmost one of the stack of disposable face masks outwardly through said slot;

a switch being positioned in the public transportation vehicle wherein said switch is configured to be accessible to a driver of the public transportation vehicle, said switch being in communication with said lifting unit in said housing and said dispenser, said lifting unit being actuated when said switch is depressed wherein said switch is configured to facilitate the driver to dispense a disposable mask for a passenger to wear; and wherein said lifting unit comprises:

a control circuit being positioned in said housing, said control circuit receiving a lift input, said control circuit receiving a refill input, said control circuit being electrically coupled to a power supply comprising an electrical system f the public transportation vehicle; and a receiver being positioned in said housing, said receiver being electrically coupled to said control circuit, said control circuit receiving said lift input when said receiver receives a lift signal, said control circuit receiving said refill input when said receiver receives a refill signal.

2. The assembly according to claim 1, wherein said housing has a bottom wall, a top wall and an outer wall extending therebetween, said outer wall having a front side, and a back side, said back side being open to access an interior of said housing wherein said back side is configured to facilitate said housing to be filled with a stack of disposable face masks, said slot extending through said front side into an interior of said housing, said slot being positioned adjacent to said top wall, said slot having an upper bounding edge and a lower bounding edge.

3. The assembly according to claim 2, further comprising a pair of doors, each of said doors having a first edge, said first edge of each of said doors being hingedly coupled to a respective one of said upper bounding edge and said lower bounding edge, each of said doors being positionable in a closed position having each of said doors lying on a horizontal plane in said slot, each of said doors being positionable in an open position having each of said doors extending forwardly from said slot.

4. The assembly according to claim 1, wherein said lifting unit includes a lifting motor being coupled to a top surface of said bottom wall of said housing such that said lifting motor is positioned within said housing, said lifting motor being electrically coupled to said control circuit, said lifting motor being actuated to rotate in a first direction when said control circuit receives said lift input, said lifting motor turning a predetermined number of revolutions each time said control circuit receives said lift input, said lifting motor being actuated to rotate in a second direction when said control circuit receives said refill input.

5. The assembly according to claim 4, wherein said lifting unit includes a screw being rotatably coupled to said lifting motor such that said screw rotates in a first direction when said lifting motor is rotates in said first direction, said screw rotating in a second direction when said lifting motor rotates in said second direction.

6. The assembly according to claim 5, wherein said lifting unit includes a tube having a first end, a second end and an interior surface, said first end being open, said interior surface being threaded, said first end insertably receiving said screw, said screw threadably engaging said interior surface, said tube being lifted upwardly each time said screw rotates in said first direction, said tube being fully lowered onto said screw when said screw rotates in said second direction.

7. The assembly accord claim 6, wherein said lifting unit includes a plate having a lower surface and a top surface, said lower surface being coupled to said second end of said tube wherein said top surface is configured to have the stack of disposable face masks positioned thereon, said plate being lifted toward said top wall of said housing when said screw is rotated in said first direction, said plate being lowered toward said lifting motor when said screw is rotated in said second direction.

8. The assembly according to claim 2, wherein said dispenser comprises a dispensing wheel being rotatably integrated into said housing, said dispensing wheel being aligned with said slot wherein said dispensing wheel is configured to frictionally engage the topmost one of the stack of disposable face masks thereby facilitating said dispensing wheel to urge the topmost one of the stack of disposable face masks outwardly through said slot, said dispensing wheel having an outer surface, said outer surface being rotated about a center point of said dispensing wheel when said dispensing wheel is rotated such that a bottom side of said dispensing wheel travels toward said slot when said dispensing wheel is rotated.

9. The assembly according to claim 8, wherein:

said lifting unit includes a control circuit, said control circuit receiving a lift input; and said dispenser includes a dispensing motor being positioned in said housing, said dispensing motor rotatably engaging said dispensing wheel, said dispensing motor being electrically coupled to said control circuit, said dispensing motor being turned on to rotate a predetermined number of rotations when said control circuit receives said lift input.

10. A mask dispensing assembly for dispensing face masks in a public transportation vehicle, said assembly comprising:

a housing being positionable in a public transportation vehicle wherein said housing is configured to be accessible to passengers on the public transportation vehicle, said housing having a dispensing slot extending into an interior of said housing wherein said dispensing slot is configured to dispense face masks stored in said housing to the passengers;

a lifting unit being positioned within said housing wherein said lifting unit is configured to have the stack of disposable face masks being positioned thereon, said lifting unit being actuated to incrementally lift upwardly in said housing wherein said lifting unit is configured to lift the stack of disposable face masks in said housing thereby aligning a topmost one of said stack of disposable face masks with said slot;

a dispenser being positioned in said housing, said dispenser engaging the topmost one of the stack of disposable face masks, said dispenser being aligned with said slot wherein said dispenser is configured to urge the topmost one of the stack of disposable face masks outwardly through said slot;

a switch being positioned in the public transportation vehicle wherein said switch is configured to be accessible to a driver of the public transportation vehicle, said switch being in communication with said lifting unit in said housing and said dispenser, said lifting unit being actuated when said switch is depressed wherein said switch is configured to facilitate the driver to dispense a disposable mask for a passenger to wear; and wherein said switch is electrically coupled to a power source comprising the electrical system of the public transportation vehicle, said switch being positionable in a lifting position or a refill position, said switch being biased into an off position.

11. The assembly according to claim 10, wherein:

said lifting unit includes a receiver; and said assembly includes a transmitter being integrated into said switch, said transmitter being electrically coupled to said switch, said transmitter being in wireless communication with said receiver in said lifting unit, said transmitter broadcasting said lift signal when said switch is positioned in said lifting position, said transmitter broadcasting said refill signal when said switch is positioned in said refill position.

12. A mask dispensing assembly for dispensing face masks in a public transportation vehicle, said assembly comprising:

a housing being positionable in a public transportation vehicle wherein said housing is configured to be accessible to passengers on the public transportation vehicle, said housing having a dispensing slot extending into an interior of said housing wherein said dispensing slot is configured to dispense face masks stored in said housing to the passengers, said housing having a bottom wall, a top wall and an outer wall extending therebetween, said outer wall having a front side, and a back side, said back side being open to access an interior of said housing wherein said back side is configured to facilitate said housing to be filled with a stack of disposable face masks, said slot extending through said front side into an interior of said housing, said slot being positioned adjacent to said top wall, said slot having an upper bounding edge and a lower bounding edge;

a pair of doors, each of said doors having a first edge, said first edge of each of said doors being hingedly coupled to a respective one of said upper bounding edge and said lower bounding edge, each of said doors being positionable in a closed position having each of said doors lying on a horizontal plane in said slot, each of said doors being positionable in an open position having each of said doors extending forwardly from said slot;

a cover being removably attachable to said housing, said cover being positionable on said back side of said outer wall to close said back side;

a lifting unit being positioned within said housing wherein said lifting unit is configured to have the stack of disposable face masks being positioned thereon, said lifting unit being actuated to incrementally lift upwardly in said housing wherein said lifting unit is configured to lift the stack of disposable face masks in said housing thereby aligning a topmost one of said stack of disposable face masks with said slot, said lifting unit comprising:

a control circuit being positioned in said housing, said control circuit receiving a lift input, said control circuit receiving a refill input, said control circuit being electrically coupled to a power supply comprising an electrical system of the public transportation vehicle;

a receiver being positioned in said housing, said receiver being electrically coupled to said control circuit, said control circuit receiving said lift input when said receiver receives a lift signal, said control circuit receiving said refill input when said receiver receives a refill signal;

a lifting motor being coupled to a top surface of said bottom wall of said housing such that said lifting motor is positioned within said housing, said lifting motor being electrically coupled to said control circuit, said lifting motor being actuated to rotate in a first direction when said control circuit receives said lift input, said lifting motor turning a predetermined number of revolutions each time said control circuit receives said lift input, said lifting motor being actuated to rotate in a second direction when said control circuit receives said refill input;

a screw being rotatably coupled to said lifting motor such that said screw rotates in a first direction when said lifting motor is rotates in said first direction, said screw rotating in a second direction when said lifting motor rotates in said second direction;

a tube having a first end, a second end and an interior surface, said first end being open, said interior surface being threaded, said first end insertably receiving said screw, said screw threadably engaging said interior surface, said tube being lifted upwardly each time said screw rotates in said first direction, said tube being fully lowered onto said screw when said screw rotates in said second direction; and a plate having a lower surface and a top surface, said lower surface being coupled to said second end of said tube wherein said top surface is configured to have the stack of disposable face masks positioned thereon, said plate being lifted toward said top wall of said housing when said screw is rotated in said first direction, said plate being lowered toward said lifting motor when said screw is rotated in said second direction;

a dispenser being positioned in said housing, said dispenser engaging the topmost one of the stack of disposable face masks, said dispenser being aligned with said slot wherein said dispenser is configured to urge the topmost one of the stack of disposable face masks outwardly through said slot, said dispenser comprising:

a dispensing wheel being rotatably integrated into said housing, said dispensing wheel being aligned with said slot wherein said dispensing wheel is configured to frictionally engage the topmost one of the stack of disposable face masks thereby facilitating said dispensing wheel to urge the topmost one of the stack of disposable face masks outwardly through said slot, said dispensing wheel having an outer surface, said outer surface being rotated about a center point of said dispensing wheel when said dispensing wheel is rotated such that a bottom side of said dispensing wheel travels toward said slot when said dispensing wheel is rotated;

a dispensing motor being positioned in said housing, said dispensing motor rotatably engaging said dispensing wheel, said dispensing motor being electrically coupled to said control circuit, said dispensing motor being turned on to rotate a predetermined number of rotations when said control circuit receives said lift input;

a switch being positioned in the public transportation vehicle wherein said switch is configured to be accessible to a driver of the public transportation vehicle, said switch being in communication with said lifting unit in said housing and said dispenser, said lifting unit being actuated when said switch is depressed wherein said switch is configured to facilitate the driver to dispense a disposable mask for a passenger to wear, said switch being electrically coupled to a power source comprising the electrical system of the public transportation vehicle, said switch being positionable in a lifting position Or a refill position, said switch being biased into an off position; and a transmitter being integrated into said switch, said transmitter being electrically coupled to said switch, said transmitter being in wireless communication with said receiver in said lifting unit, said transmitter broadcasting said lift signal when said switch is positioned in said lifting position, said transmitter broadcasting said refill signal when said switch is positioned in said refill position.

* * * * *